United States Patent [19]

Hartz

[11] Patent Number: 4,905,994

[45] Date of Patent: Mar. 6, 1990

[54] TILTING ROTATIONAL RECREATIONAL DEVICE

[76] Inventor: Billy J. Hartz, 4016 NE. 110th, Seattle, Wash. 98125

[21] Appl. No.: 102,081

[22] PCT Filed: Dec. 3, 1986

[86] PCT No.: PCT/US86/02639

§ 371 Date: Aug. 31, 1987

§ 102(e) Date: Aug. 31, 1987

[87] PCT Pub. No.: WO87/03500

PCT Pub. Date: Jun. 18, 1987

Related U.S. Application Data

[63] Continuation-in-part of Ser. No. 806,652, Dec. 6, 1985, abandoned.

[51] Int. Cl.[4] ..... A63B 69/18

[52] U.S. Cl. ..... 272/146; 272/97

[58] Field of Search ..... 272/146, 96, 97, 111, 272/93; 128/25 R, 25 B; 403/405.1, 407.1, 408.1, 409.1

[56] References Cited

U.S. PATENT DOCUMENTS

| | | | |
|---|---|---|---|
| D. 278,924 | 5/1985 | Seel et al. | 272/146 |
| 2,351,293 | 6/1944 | Saunders | 272/146 |
| 3,984,100 | 10/1976 | Firster | 272/96 |
| 4,290,601 | 9/1981 | Mittelstadt | 272/146 |
| 4,638,996 | 1/1987 | Simjian | 272/146 |
| 4,679,550 | 7/1987 | Quam et al. | 272/146 |

FOREIGN PATENT DOCUMENTS

| | | | |
|---|---|---|---|
| 0961709 | 9/1982 | U.S.S.R. | 272/146 |

*Primary Examiner*—Stephen R. Crow

*Attorney, Agent, or Firm*—Patrick M. Dwyer; David L. Garrison

[57] ABSTRACT

A tilting rotational recreational device which has a platform on which the user stands, which platform is freely rotatable upon a bearing. The angle of the platform with respect to the horizontal may be adjusted so that a user standing or sitting on the platform may induce rotational movement of the platform easily by shifting his or her center of mass. One or more additional bearings placed internally in the device optionally provide random and unpredictable rotational movements of the platform, depending on the nature of the user's shift of mass. The device may be locked into a particular angle adjustment, and all internal parts may be held securely together to facilitate safe and reliable use.

12 Claims, 5 Drawing Sheets

TILTING ROTATIONAL RECREATIONAL DEVICE

This is a Continuation in Part of application Ser. No. 806,652, filed Dec. 6, 1985, now abandoned.

TECHNICAL FIELD

This invention relates to the field of recreational devices and more particularly to motor skill oriented devices of the type using a rotationally mounted table upon which the user stands. More particularly this invention concerns a floor supported rotationally mounted platform the rotational axis of which may be angled from the perpendicular so that the platform assumes an attitude not parallel to the floor or other surface supporting the device.

BACKGROUND ART

It is well known in prior devices to mount a platform as a support surface upon a bearing means so that the platform can rotate in a horizontal plane. The devices are used as exercise devices or playthings by a user standing on the rotationally mounted platform by swinging his or her arms and other body parts so that a swivel motion occurs. These devices have been touted as providing exercise simulating downhill skiing and as a means to provide body conditioning helpful for the downhill skier.

While simulating some of the movements encountered in downhill skiing, all but one of the devices do not provide any simulation of the downhill attitude assumed by skis in use. When one practices with most of the prior art devices and then indulges in alpine or downhill skiing activities, the practice on the prior art device induces muscular and balancing actions which cause the skis to point uphill rather than down the fall line as is desired. It is theorized that the configuration of the prior art device, being horizontal, conditions the user's muscles so that a natural response upon encountering an inclined surface is to cause the skis to be pointed around to the horizontal attitude. While the reason for this response is not fully understood it is noted that in all but one of the prior art devices, locating or shifting body weight to a location eccentric to the axis of rotation of the device does not induce a rotational moment about the axis.

In the one prior art device in which a shifting of body weight to a location eccentric to the axis of the rotation of the device induces a rotational moment about the axis, the members of the device which effectuate the angling of the rotational axis from the perpendicular are not capable of being locked together during use of the device and thus the angular adjustment may slip and change, and the entire device can come apart during vigorous use.

None of the prior art devices contain more than one bearing means to introduce an element of unpredictability to the rotation of the platform.

DISCLOSURE OF INVENTION

The present invention differs from most of the prior art in that locating a weight eccentrically to the axis of rotation of the rotationally mounted platform of the invention causes a rotational moment to be applied to induce rotation of the platform and a user standing thereon.

The recreational device of this invention comprises a base member having means therein to mount a weight supporting bearing means which may be angled with respect to the horizontal. The bearing means carries a rotatable platform thereon and is adapted for rotation with respect to the base and may be angled so that the axis of rotation is non-vertical.

In a preferred embodiment of this invention this angle is variable so that a user may set the desired angle to suit his or her particular needs, be it for recreational gaming type use or serious exercise or in preparation for alpine or downhill skiing. Alternately, two or more users may set the angle needed and simultaneously use the device. In another mode of operation two or more users may each simultaneously use individual devices and compete or cooperate in games and exercises.

The angle is set in the preferred embodiment by manipulating elements of the base means so that the mount of the bearing is angled with respect to, but still in a weight supporting relationship with, the floor engaging lower surface of the base means. With the bearing and the platform mounted thereon thus angled, the device permits the user to induce rotational movement by deliberately shifting body weight or center of mass to cause controlled rotation of both platform and user. Both the rate of rotation and whether or not the user performs complete rotations or swings or other indicia of performance are thus controllable by the user by merely shifting his center of mass away from the axis of rotation. Individuals or partner-type activities can be undertaken as either games or exercise activities by using one or more of the rotational devices. The single bearing device used singly simulates the motions encountered in downhill skiing more closely than having the device positioned with its rotational platform parallel to the support surface.

The structure of this invention also departs from prior art in which an eccentrically located weight brings about rotation of the platform and the user standing on it, in that this invention is so constructed that the elements for changing the angle of the rotating platform may be easily manipulated to create new angles, but during use those elements may be locked into place and thereby any potentially dangerous vertical, lateral, or rotational displacement of the angle adjusting elements with respect to one other during use is prevented.

In addition, the structure of this invention departs from all known prior art in that one embodiment of the invention comprises one or more additional bearing means. This additional bearing means when unlocked and allowed free rotation makes possible a totally different kind of movement in a rotating recreational device, which movement is unpredictably variable and therefore recreationally very challenging.

BEST MODE FOR CARRYING OUT THE INVENTION

Figure 1:
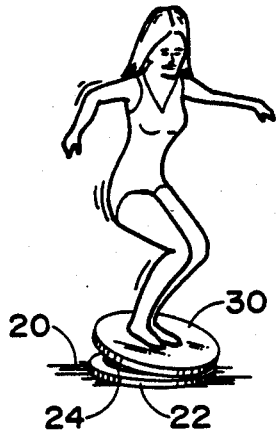
FIG. 1 is a perspective view of the device of this invention in use.
Figure 2:
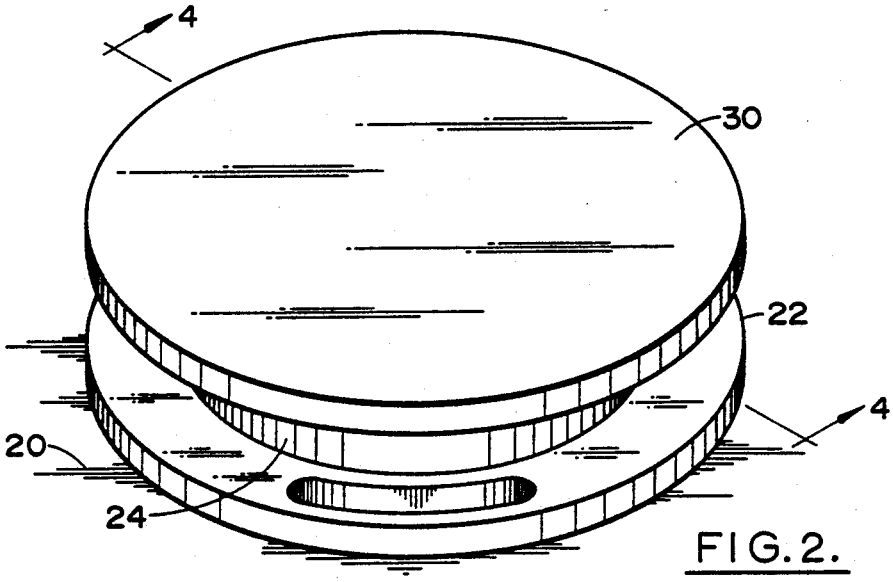
FIG. 2 is a larger perspective view of one embodiment of this invention.
Figure 3:
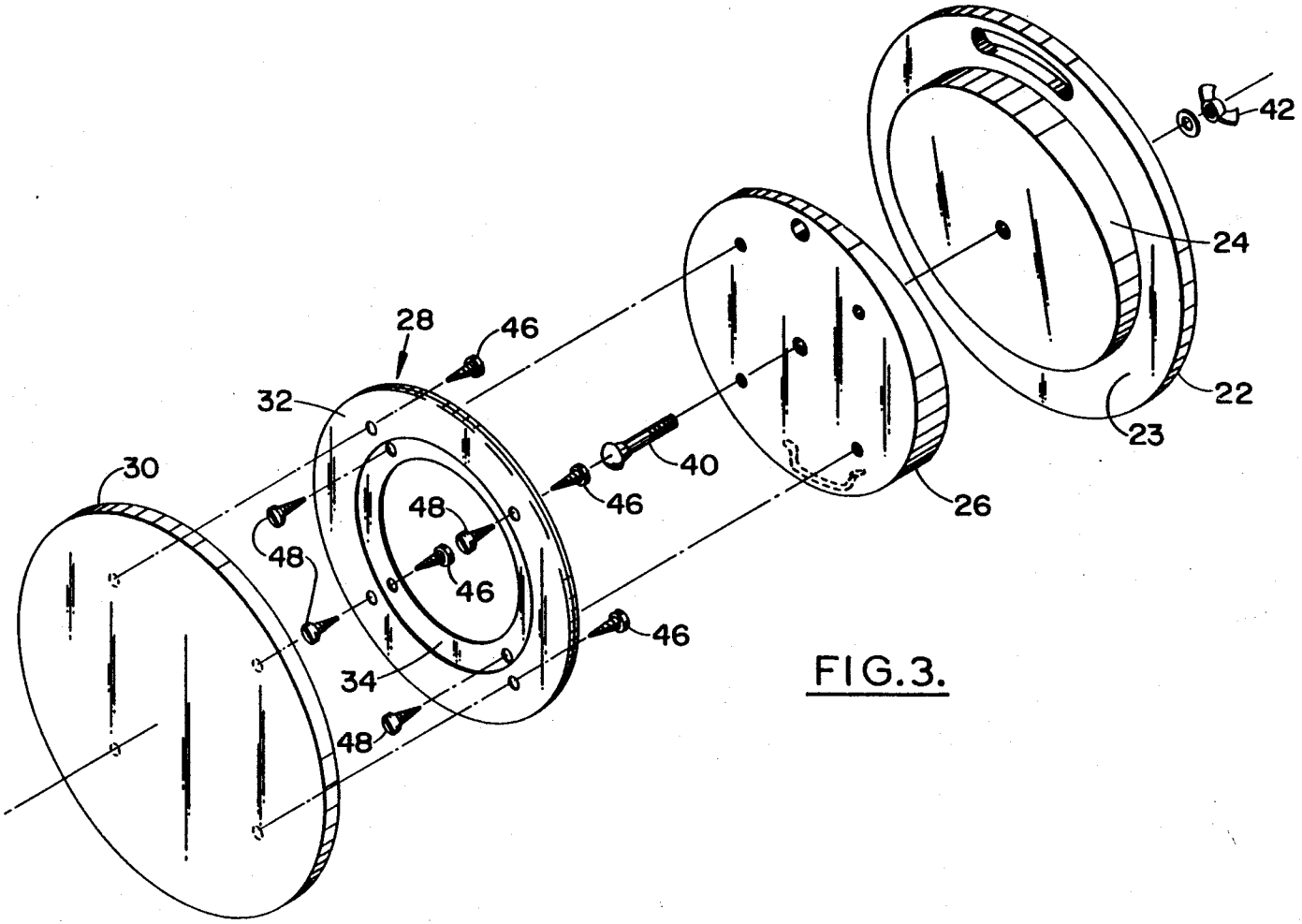
FIG. 3 is an exploded perspective view of the device shown in FIG. 2.
Figure 4:
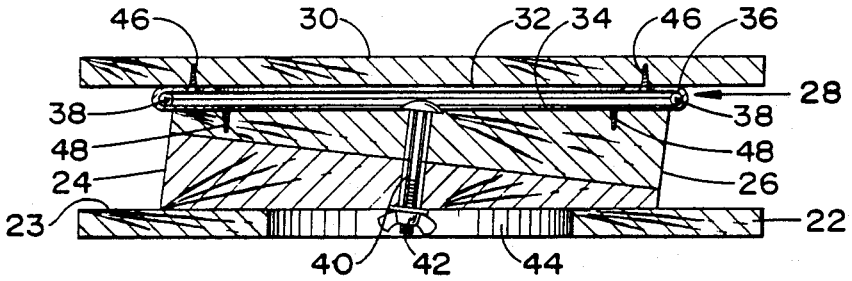
FIG. 4 is a cross sectional view of the apparatus shown in FIG. 2 taken along line 4—4 of FIG. 2.
Figure 5:
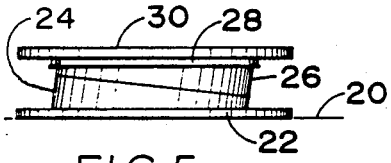
FIG. 5 is a schematic side view of the apparatus shown in FIG. 2 with the base positioned in the horizontal platform mode.
Figure 7:
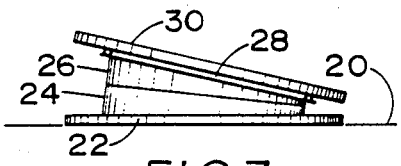
FIG. 6 and 7 are views like FIG. 5 with the base elements rotated to various angular positions so that the platform is angled.
Figure 6:
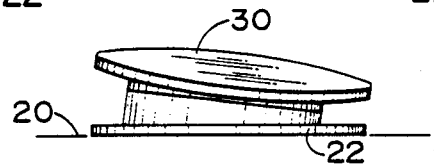

Referring specifically to the drawings, wherein like numerals indicate like parts, there is seen in FIGS. 1–7 a first and preferred embodiment of this invention, which may be constructed of wooden, plastic, metal or other materials, shown resting on a support surface 20. Base plate 22 engages and is supported by surface 20 and has mounted upon its upper surface 23, a lower skew cut column member 24. Column member 24 engages and supports a superjacent upper skew cut column member 26 positioned for rotation upon the upper surface of lower skew cut column member 24. The two column members 24 and 26 are held together in an axially aligned relationship by bolt 40 secured by wingnut 42. Bolt 40 runs through coaxial bores in column members 24 and 26 which are sufficiently greater in diameter than the bolt, as shown in FIG. 4, that whenever wingnut 42 is loosened, column members 24 and 26 can be easily rotated with respect to each other so that the skew cut configuration enables the desired change in the inclination of the weight support surface of the device.

To permit the upper rotatable platform 30 to turn, a bearing mechanism 28 is attached to the upper surface of the upper skew cut column member 26 by fasteners 48. The fasteners 48 extend downwardly through lower bearing plate 34 which is thus firmly attached to the column member 26. Ball bearings 38 run in raceway 36 in a well known turntable or swivel type bearing structure. The upper bearing plate is supported upon the ball bearings 38 and carries platform 30 firmly attached thereto by fasteners 46. Base plate 22 has an axial aperture 44 to house and permit access to wingnut 42.

In the preferred embodiment a plurality of plywood cylindrical elements were first glued together in stacked fashion to form a cylinder approximately 12 inches in diameter and three inches thick. This cylinder was then cut along a plane which was not perpendicular to the axis of the cylinder. The resulting skew cut cylindrical sections were then reversed in their positions so that a smooth, uncut surface of each engaged the other. When assembled the cylindrical column sections 24 and 26 assume the slightly canted appearance as shown in the side views of the drawings. Of course, other materials may be used to construct the device, especially injection molded plastics.

In use the apparatus of this invention is first positioned on a support surface such as a floor or slab and the angular relationship between the base plate 22 and the platform 30 set. In the preferred embodiment shown in FIGS. 1–7 the angular relationship is established by loosening the wingnut 42 and rotating upper skew cut column 26 with respect to lower skew cut column 24. When the desired inclination of platform 30 is achieved, wingnut 42 is tightened to hold the parts of the device firmly together and thus prevent any potentially dangerous or recreationally disruptive lateral, vertical, or rotational displacement of the column members relative to each other. The user then mounts the platform and by moving parts of her body so as to change her center of mass, causes the platform and the user to rotate, either partially or continuously. By timed movements, the user can accelerate or decelerate angular motion as desired.

Figure 8:
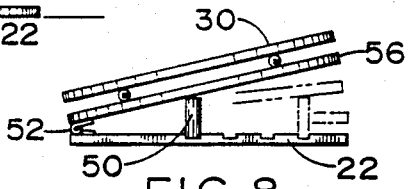
FIG. 8 is another embodiment of this invention.

In FIGS. 8–12 and 16 there are shown several different embodiments of the invention, each having a different means for altering the angular relationship between the base plate 22 and the rotatable platform 30. In FIG. 8 a hinged structure is used in which a prop 50 is placed into one of several possible positions at various distances from hinge 52. The angle assumed by the rotatable platform 30 depends upon how close the prop is placed to the hinge.

Figure 9:
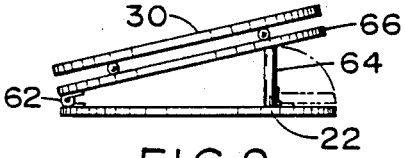
FIG. 9 is another embodiment of this invention.

FIG. 9 shows a simple hinged structure for the means to set the angle of the platform 30. In this embodiment hinge 62 permits the platform to be tilted with respect to the base 22 with the hinged link 64 providing the support for the upper hinged portion 66 of the base, either at the lower position with link 64 positioned horizontally or in the steeply angled position with link 64 upright. In both the embodiment shown in FIG. 8 and in FIG. 9 the separate elements of the respective angle adjusting means are located in place during use by the weight of the user upon the rotational means, such that it is not possible to alter or change the angle of the rotating platform while the user is standing upon it.

Figure 16:
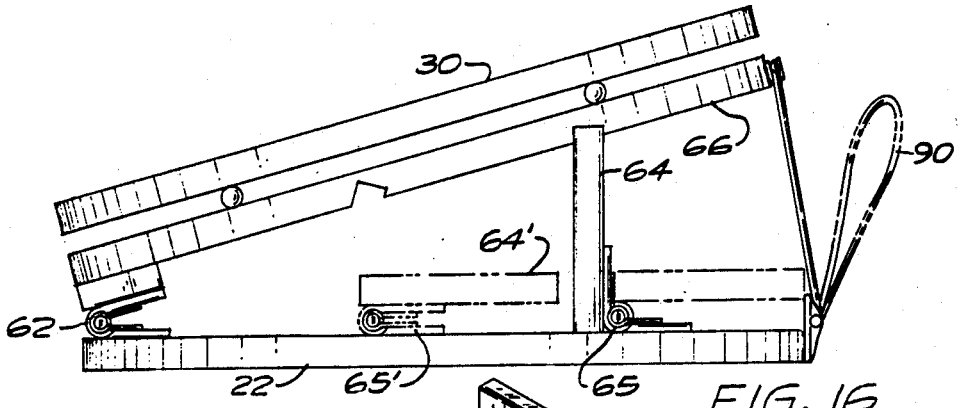
FIG. 16 is a schematic side view of another embodiment of the invention shown in FIG. 9.

FIG. 16 shows an alternate embodiment to the invention shown in FIG. 9. Both hinges 62 and 65 are spring loaded with a bias toward the closed position of the hinge. Upper hinged portion 66 of the base contains a depression into which the top part of hinged link 64 fits snugly such that even with relatively light weight users standing upon the rotating platform, the spring bias of the spring loaded hinges 65 and 62 and the snug fit of link 64 into hinge portion 66 additionally assures that there can be no displacement of the angle adjusting elements during use of the device. A fail safe elastic means 90 is also shown for the purpose of holding upper hinge portion 66 under tension against the resistance of hinge link 64 to base 22. FIG. 16 shows one additional hinged link 64' with spring loaded hinge 65' which is placed at a point intermediate hinge link 64 and hinge 62 in order to provide a variable means of adjusting the angle of the rotating platform in this embodiment of the invention.

Figure 10:
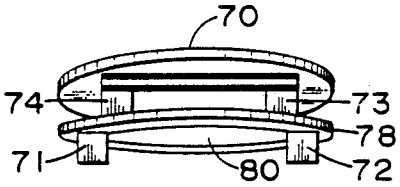
FIG. 10 is yet another embodiment.
Figure 11:
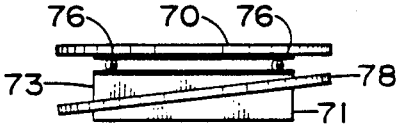
FIG. 11 is a side view of the apparatus of FIG. 10 with the base elements rotated into the horizontal platform mode.
Figure 12:
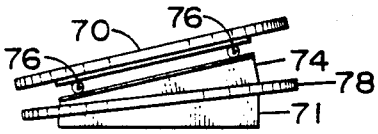
FIG. 12 is another side view of the apparatus shown in FIG. 10 with the base elements rotated into the maximum incline mode.

Another embodiment, shown in FIGS. 10–12, uses pairs of inclined wedges which cooperate rotatively to set the angle of inclination of platform 70. In FIG. 10 an end elevational view is shown in which the maximum inclination of platform 70 is achieved by having the pairs of inclined wedges 71 and 72 positioned parallel to wedges 73 and 74. Wedges 71 and 72 each rest on the floor and carry support ring 78, inclined with respect to the floor on their upper surface. Disc 80 fits inside ring 78 and rides on wedges 71 and 72, while carrying wedges 73 and 74 firmly attached to its upper surface. Wedges 73 and 74 may thus be rotated as a unit with respect to wedges 71 and 72. Wedges 73 and 74 have a turntable bearing attached to carry the rotatable platform 70. Thus by rotating the upper wedges 73 and 74 with respect to the lower wedges 71 and 72 the platform angle can be varied from that shown in FIG. 11 with the platform 70 in a substantially horizontal attitude to a maximum inclination of that shown in FIG. 12. In use it has been found that the maximum inclination for satisfactory operation of the device under normal operating conditions is approximately 20 degrees from the horizontal. However, for certain applications, such as for simulation and training in steep downhill or alpine skiing, a maximum inclination of about 30 degrees from the horizontal can be used.

Figure 13:
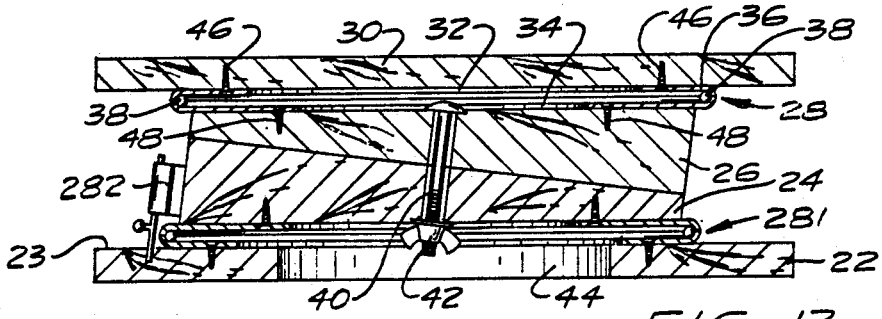
FIG. 13 is a cross sectional view of another embodiment of the invention which view is similarly derived as in FIG. 4, with the addition of a second weight supporting bearing means.

An alternate embodiment of this invention utilizes a plurality of bearing means, at least one above and at least one below the means for adjusting the angle of the axis of the device. A detail of this embodiment showing a second bearing means 281 is contained in FIG. 13. In this more complex configuration an element of uncertainty is introduced in operation since the user will not know which bearing means will operate under any given motion so that the device is more difficult to operate and will require the development of skills in operation beyond that necessary to operate the device of FIGS. 2–7. A locking means 282 is shown to hold stationary this second bearing means so that this embodiment may be operated at the user's option in the same manner as the preferred embodiment described above.

Figure 14:
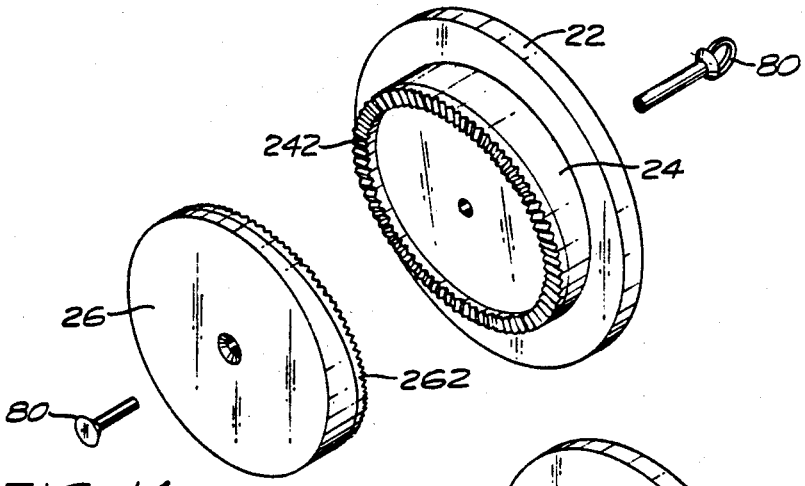
FIG. 14 is an exploded perspective view of the angle adjusting means of another embodiment of the apparatus shown in FIG. 2.
Figure 15:
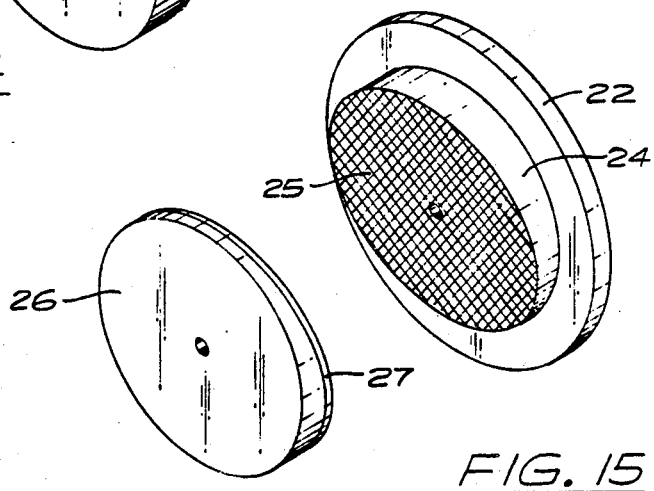
FIG. 15 is an exploded perspective detail view of an alternate embodiment of the angle adjusting means of FIGS. 14 and 2.

FIGS. 14 and 15 contain details of the angle adjusting columns 24 and 26 not shown in previous figures. These details relate to an improved method of holding column members 24 and 26 together as a unit during use of the device. FIG. 14 shows the mating surfaces of members 24 and 26 each with dependent rings of teeth 242 and 262 respectively, such that when the members 24 and 26 come together the respective rings of teeth mesh perfectly and prevent any rotational displacement of the two members with respect to one another when locked in place by the clamping means. As alternatives to the toothed ring means shown in FIG. 14, FIG. 15 shows two additional means of insuring that the column members 24 and 26 do not move rotationally with respect to each other during use of the device. One means comprises cross hatching 25 in both mating surfaces of members 24 and 26 by some suitable mechanical means, or if the parts are injection molded, by plastic cross hatchings molded into the mating surfaces of members 24 and 26. A second means comprises a friction layer means 27 attached to each of the mating surfaces of members 24 and 26 shown generally in FIG. 15 as depending from and coextensive with its respective column member. In either the case of the cross hatching or the friction layer means, the two column members may be axially clamped together with a relatively light pressure and still assure that there is no rotational movement therebetween.

Figure 17A:
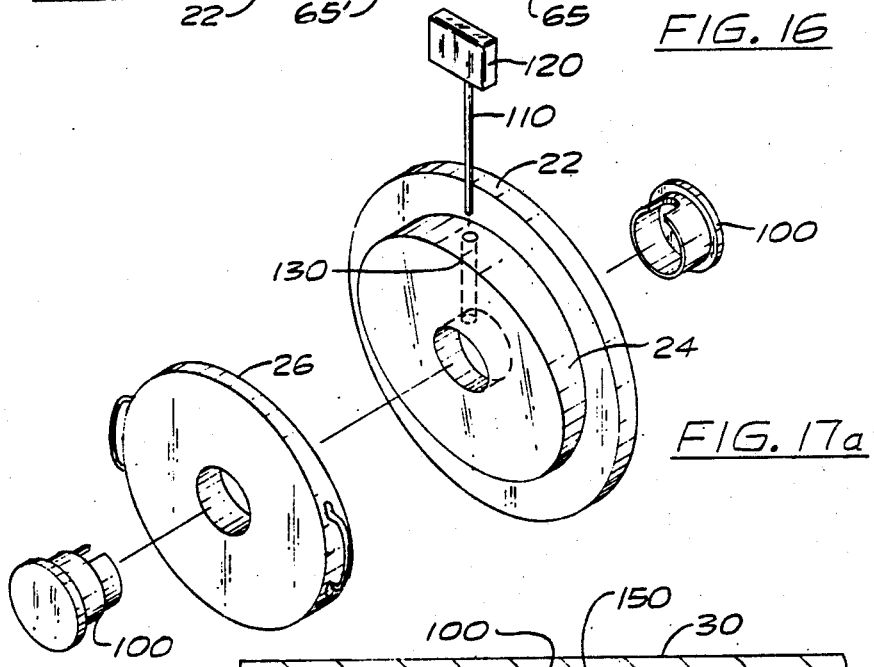
FIG. 17*a* is an exploded perspective detail view of another embodiment of the invention.
Figure 17B:
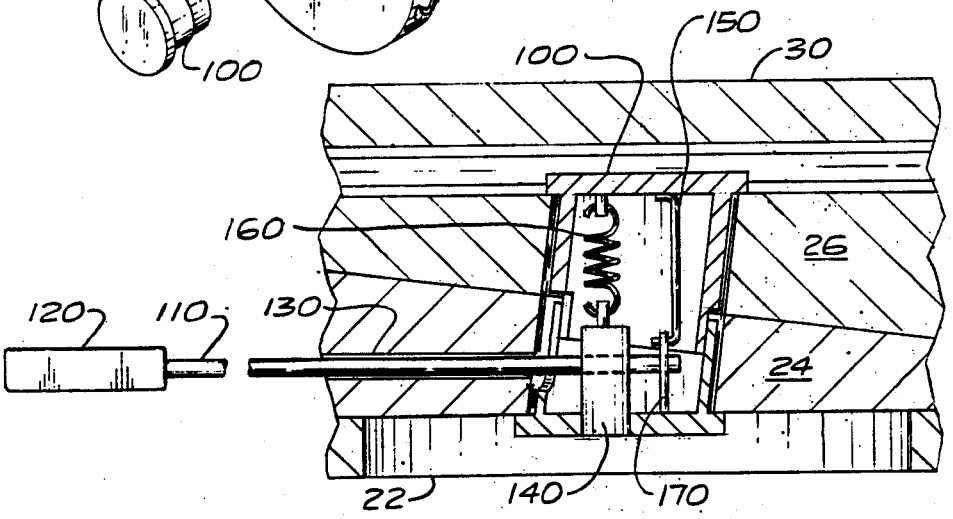
FIG. 17*b* is a cross sectional detail view of the apparatus shown in FIG. 17*a*.

In FIG. 14 there is additionally shown an axial locking means which is an alternative to the bolt 40 and wingnut 42 of FIG. 3. What is shown is a schematic representation of a releasable two part axial link 80 of well known type. When the two parts are released by manipulating a pull ring or a push knob with the thumb and fingers of a single hand, the two part axial link 80 may be separated, at least to the extent that the various friction or tooth ring means may be disengaged and the column members may thus be turned to effect the adjustment of the angle of the rotating platform before snapping together the two parts of axial link 80 to relock the column members together again. FIG. 17*a* and 17*b* show yet another alternative to the bolt and wingnut or the two part releasable axial clamp 80. In all of the embodiments described above the device must be turned on its edge or upside down in order to effect adjustment of the angle adjusting means. In this embodiment a hollow two part axial means 100 which is flanged on both ends and internally spring loaded holds the column members 24 and 26 immovably together when the axle 100 is compressed. A foot pedal 120 and a rod 110 serve to actuate a cam 170 and an expander link 150 to elongate the axle means 100 and thereby release the pressure of the flanges against the respective column members so that the user, while standing upon the foot pedal, may with the aid of the two handles on the upper column member lift it slightly and turn it to the desired angular position. Then by simply stepping off of the foot pedal, the user allows the column members to once again become fixed in relation to one another and locked in place by the spring tension action of the internal spring and the axle means.

INDUSTRIAL APPLICABILITY

The invention described herein finds use as a recreational device wherein the motor skills of the user are tested and honed in the operation thereof. The apparatus may be used as a game type device or as a serious exercise and physical training device for athletes as well as for individuals with physical disabilities. The unique combination of the rotational movement coupled with and complemented by the angled or inclined orientation of the upper platform results in physical movements for the user not heretofore encountered. This is especially so in the embodiment with the multiple bearing means.

In all embodiments of this invention, the elements of the angle adjusting means are held firmly in place during use, thus no disruptive or potentially dangerous lateral, vertical, or rotational displacement of the respective angle adjusting elements relative to one another can occur. The invention thereby provides heightened safety and enjoyment of the recreational use of the device.

In compliance with statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

I claim:

1. A tilting rotational recreational device comprising:

(1) a base member adapted to be placed upon a support surface; and (2) a rotatable platform member adapted to support a person using the device; said base member having (a) a base plate in contact with said support surface, (b) at least one weight supporting bearing means mounted therein, (c) a means for establishing an angular displacement between the plane of said support surface and the plane of rotation of said platform member, and (d) a releasable locking means for fixing said angular displacement in a selected angular alignment, said releasable locking means further comprising an axial fastener;

said means for establishing said angular displacement having upper and lower wedge shaped elements vertically interengaged and releasably held together in axial alignment by said fastener to permit rotation of said elements relative to one another about an axis of rotation common to both wedge shaped elements, whereby said angular displacement may be adjustably set, said fastener running through bores in said upper and lower wedge shaped elements such that said fastener is coaxial with said axis of rotation common to said upper and lower wedge shaped elements; and wherein said platform member is mounted upon one weight supporting bearing means and said bearing means is mounted upon said means for establishing said angular displacement, said platform member thereby being capable of freely rotating relative to said base member, upon said bearing means.

2. The apparatus of claim 1 wherein said wedge shaped elements are rotatably interengaged upper and lower skew cut column members, each of said members having upper and lower surfaces in nonparallel planes wherein said bearing means is mounted upon said upper surface of said upper column member, whereby rotation of said upper column member with respect to said lower column member adjustably sets said angular displacement.

3. The apparatus of claim 1 wherein said wedge shaped elements are inclined upper and lower paired wedge members, said upper pair of wedge members rotatable as a unit with respect to said lower pair of wedge members by mounting the upper surfaces of said lower pair of wedge members to the lower surface of an annular support member that is adapted to receive and support in turn a disk shaped support member rotatably interengaged within said annular support member, wherein the lower surfaces of said upper pair of wedge members are mounted to the upper surface of said disk shaped support member, and wherein said bearing means is mounted to the upper surfaces of said upper pair of wedge members, whereby said angular displacement may be adjustably set by rotating said pairs of wedge members and their respective said support members relative to one another.

4. The apparatus of claim 2 wherein said axial fastener is engaged in a coaxial bore of diameter substantially larger than the diameter of said fastener, whereby said upper and lower column members may rotate freely relative to each other without said fastener interfering with the walls of said bore.

5. The apparatus of claim 1 having an upper weight supporting bearing means mounted upon said means for establishing said angular displacement and a lower weight supporting bearing means mounted below said means for establishing said angular displacement.

6. The apparatus of claim 5 further comprising a means to releasably lock said lower weight bearing means from any rotation therein.

7. The apparatus of claim 4 wherein the respective mating surfaces of said upper and lower column members have respectively axially depending and projecting multi-denticulated rings at the circumferences of each of said mating surfaces, wherein said respective rings mesh and interengage with each other to releasably prevent relative rotation between said upper and lower column members when said means for fixing angular displacement is engaged to hold said column members to each other.

8. The apparatus of claim 7 wherein (a) said means for fixing said angular displacement further comprises a well known type of two part spring loaded separable fastener which can be separated by the manipulation of the fingers and thumb of one hand and which contains suitable flanges at both ends of said fastener such that, when said fastener is fastened together, said column member surfaces are held substantially in a mated interengaged relationship; and (b) the user operated portion of said fastener means is located in a counter sunk portion of the bottom surface of said base member, such that the recreational user can release the clamp with one hand while holding the device in the other hand and thereby easily reposition said interengaging denticulated rings before reconnecting the fastener.

9. The apparatus of claim 4 further comprising friction enhancing means disposed upon each of the mating surfaces of said upper and lower column members.

10. The apparatus of claim 9 in which said friction enhancing means further comprises a layer of well known frictional surface material such as sandpaper or non-slip rubber which is adhesively bonded to the respective surfaces of said column members.

11. The apparatus of claim 9 wherein said friction enhancing means further comprises mechanically etched or cast in cross hatching upon the mating surfaces of said upper and lower column members, such that said cross hatching creates such irregularities on said mating surfaces that one surface thereby has a grip upon the other surface when suitably clamped by said means to fix said angular displacement.

12. The apparatus of claim 2 wherein said means for fixing said angular displacement further comprises:

a foot pedal actuated rod which rotates in a bore placed radially in said lower column member and which terminates in a cam member;

a two piece hollow closed cylindrical axle member where each end of said closed cylindrical axle member contains substantial flanges radially projecting from their respective end surfaces and where each of said two pieces of said axle member is slidably engaged one within the other so that the length of said axle member is variable depending upon the position of one of said pieces with respect to the other of said pieces;

within said axle member, an off center upwardly protruding tab fastened or integrally attached to the bottom inner surface of said axle member in which is a pivotal bore in which said rod is free to rotate and turn said cam member; also within said axle member, a suitable tension means such that the normal tendency of the flanges of said axle member is to draw together and thus clamp said column members together;

and also within said axle member, an expander link connected to an upper lobe of said cam and to the upper end surface of said axle member; whereby the user, while standing on said pedal, may then rotate said upper column relative to said lower column member by said grasping means without having to invert said tilting rotational recreational device.

* * * * *